United States Patent [19]

Bakhalov et al.

[11] 4,161,148

[45] Jul. 17, 1979

[54] METHOD OF SEWING A BUTTON ON A THREAD STEM AND SEMI-AUTOMATIC MACHINE FOR PERFORMING SAME

[75] Inventors: Vladimir I. Bakhalov, Moscow; Gennady V. Volvenkov, Moskovskaya oblast, Scherbinka; Valentin P. Polukhin, Moskovskaya oblast, Vidnoe; Vadim S. Starokadomsky; Arkady V. Ter-Bogdasarov, both of Moscow, all of U.S.S.R.

[73] Assignee: Vsesojuzny Nauchno-Issledovatelsky Institut Legkogo I Textilnogo Mashinostroenia, U.S.S.R.

[21] Appl. No.: 869,013

[22] Filed: Jan. 12, 1978

[30] Foreign Application Priority Data

Feb. 10, 1977 [SU] U.S.S.R. ..... 2448962

[51] Int. Cl.[2] ..... D05B 3/14

[52] U.S. Cl. ..... 112/110

[58] Field of Search ..... 112/110, 111, 112, 104, 112/204

[56] References Cited

U.S. PATENT DOCUMENTS

| | | | |
|---|---|---|---|
| 1,336,346 | 4/1920 | Darley | 112/110 |
| 2,391,378 | 12/1945 | Avis | 112/110 |
| 3,182,618 | 5/1965 | Pedersen | 112/110 |
| 3,329,111 | 7/1967 | Pedersen et al. | 112/110 |
| 3,650,229 | 3/1972 | Rovin | 112/204 |

*Primary Examiner*—H. Hampton Hunter

*Attorney, Agent, or Firm*—Steinberg and Blake

[57] ABSTRACT

In the method of the present invention of sewing a button, simultaneously with guiding the needle thread through the holes of the button and through the cloth and forming from this thread a foot between the button and the cloth, a stem is also formed by wrapping the thread about the foot being formed. To perform this wrapping around the foot being formed with the needle thread, a reserve length of this thread is provided after guiding it through one of the holes of the button and through the cloth, this reserve length being used to wrap around the foot being formed, simultaneously with the successive guiding of the thread through the holes of the button and the cloth. In the semi-automatic machine for performing this method there is incorporated a stem-forming device comprising a trough rotatable about the needle, having one end thereof underlying the button holder, and a means for engaging the thread and providing the reserve length thereof, mounted for passage through the trough to underlie the button holder and for clearing the trough upon the reserve length of the thread having been provided and the trough rotating. The invention significantly increases the productivity of labor, enhances the fastening of a button and increases the latter's wearability.

6 Claims, 6 Drawing Figures

METHOD OF SEWING A BUTTON ON A THREAD STEM AND SEMI-AUTOMATIC MACHINE FOR PERFORMING SAME

The present invention relates to equipment for the clothing industry, and more particularly it relates to methods and semi-automatic machines for sewing buttons on a cloth by a stem of thread.

At present, sewing-on of a button on cloth by a stem of thread is performed by the commonly known method including holding the button to be sewn on at a predetermined spacing from the cloth, guiding through the holes of the button and through the cloth the needle thread of which subsequently a foot is formed under the button in the thread-guiding operation, and then wrapping the thread around this foot to form the stem. This method is usually performed by a known semi-automatic buttoning machine having a housing supporting thereon, intermediate the needle bar with the needle and the throat plate, a button holder spaced from the throat plate by a preset distance and adapted to hold a button above the cloth. After the needle has guided the thread through the holes of the button through the cloth and the foot having been formed therebetween, the foot is wrapped around with the thread to form the stem—either in the same semi-automatic machine or in another one. While the foot is being wrapped around with the thread, the button is held perpendicularly to the slide in the correspondingly indexed button holder, and the foot is wrapped around by making stitches on both sides of the foot.

However, this method is characterized by relatively low productivity, since the process of sewing on the button with the formation of the foot, and the formation of the stem are performed successively one after the other.

Known in the art is also a method of sewing on a button according to which simultaneously with the process of guiding the needle thread through the holes of the button and the cloth and forming the foot, there is effected intermittent rotation of the button about its axis, when the needle is above the button. Thus, the stem is formed by twisting the threads in the foot and intertwining them by rotation of the button. This method reduces the time of sewing a button by nearly one half. However, the additional twisting of the thread by the rotation of the button somewhat affects the conditions of tightening the stitch and requires increasing the tension of the needle thread, which has been found to reduce the stability of the sewing operation.

Besides, the stem produced in this manner is not protected from the rubbing wear by the wrap-around thread which is absent altogether, which affects the wearability of the sewn-on button.

The main object of the present invention is to provide a method of sewing a button on a stem of thread, which offers an increased productivity.

Another object of the present invention is to provide a method of sewing a button, which would improve the quality of the fastening of the button.

Still another object of the present invention is to provide a semi-automatic machine for sewing a button on a thread stem, which is capable of performing the disclosed method.

These and other objects are attained in a method of sewing a button on a thread stem, wherein a button being sewn on is held at a preset distance from the cloth, whereafter the needle thread is guided through a hole of the button and through the cloth, a foot being formed of this thread under the button, and the thread is wrapped around this foot to provide a stem, in which method, in accordance with the invention, following the guiding of the needle thread through one of the holes of the button and the cloth, a reserve length of this thread is provided intermediate the button and the cloth, this reserve length being used to wrap around the foot being formed to provide the stem, simultaneously with the successive guiding of the thread through the holes of the button and through the cloth.

The method of the present invention is performed by a semi-automatic machine having a button holder between the needle bar with the needle and the throat plate underlying the needle, at a predetermined spacing from the throat plate. The machine, in accordance with the present invention, comprises a device for forming a stem, and includes a trough having one of its ends underlying the button holder and being rotatable about the needle during a button-sewing operation. A device for engaging the needle thread and providing a reserve length thereof, following the guiding of this thread through one of the holes of the button, is slidably mounted for forwardly passing through the trough so that its lower end underlies the button holder at the moment of engaging the thread and for rearwardly leaving the trough while providing the reserve length of the thread and upon of the trough.

The herein disclosed method and the semi-automatic machine for sewing a button on a stem of thread results in a reduction of the time of sewing on the button by combining the operations of forming the foot and forming the stem, in which way the productivity of the semi-automatic machine is significantly increased. Furthermore, the quality of the fastening of the button is significantly enhanced, with the foot being wrapped by turns of the thread, each turn being secured with the threads of the foot, which precludes unwrapping of the wrap-around threads, reduces the number of the thread ends to one half and obviates the necessity of fixing the end of the wrap-around thread.

It is expedient that the device engaging the needle thread and providing a reserve length thereof should include a plate having one of its ends connected to a drive for moving the plate as it passes through the trough, the other end of the plate having an opening alignable with the opening in the throat plate, as this end of the plate is driven to underlie the button holder. Having a very simple structure, this device ensures reliable engagement of the needle thread between the button and the cloth, after the thread has been driven for the first time through a hole in the button and the cloth.

It is further expedient that the plate should be accommodated in guideways fixed to the housing of the machine, which enables the plate to be accomodated without affecting the conditions of operating and maintaining the machine and does not complicate the structure and shape of the latter.

In accordance with one of the features of the present invention, the device for forming the stem includes, to effect the rotation of the trough about the needle, a driving ring arranged coaxially with the opening in the throat plate, the ring being rotatably pivotally mounted on the housing of the machine and having the trough secured thereto in a cantilever fashion. This feature offers the simplest structure, with the trough affecting neither the visibility of the needle-button holder area nor the conditions of locating the button, the thread and the cloth.

It is further expedient that the trough should be of an arcuate shape, its length being selected to provide for full accommodation of the reserve length of the thread therein upon the device for engaging the thread and providing its reserve length exiting therefrom, which provides for reducing the overall dimensions of the machine and facilitates its operation.

It is still further expedient that the end of the trough, underlying the button holder, should be provided with a slot and with means for tensioning the reserve length in the form of a leaf spring having one of its ends fixed to the trough and its other end extending into the slot therein, which improves the quality of the first stitches, owing to the reserve length of the thread being retained, and increases the density and rigidity of the stem being formed.

Altogether, the method of the present invention and semi-automatic machine for sewing a button on a thread stem enable a significant increase in the productivity of labor, an improvement the quality of the attachment of the button and its wearability. Of essential importance is the fact that the herein disclosed semi-automatic machine can be readily constructed on the basis of any existing semi-automatic buttoning machine, without introducing any substantial changes into the latter's design.

The invention will be further described in connection with an embodiment thereof in a method for sewing a button on a stem of thread and in a machine capable of performing this method, with reference being had to the accompanying drawings, wherein.

Figure 5:
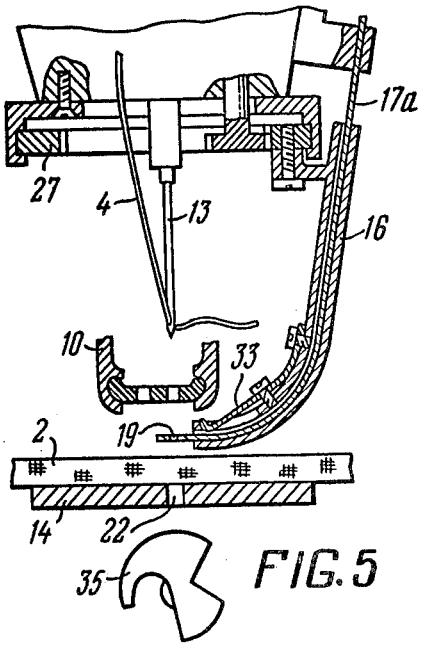
Figure 2:
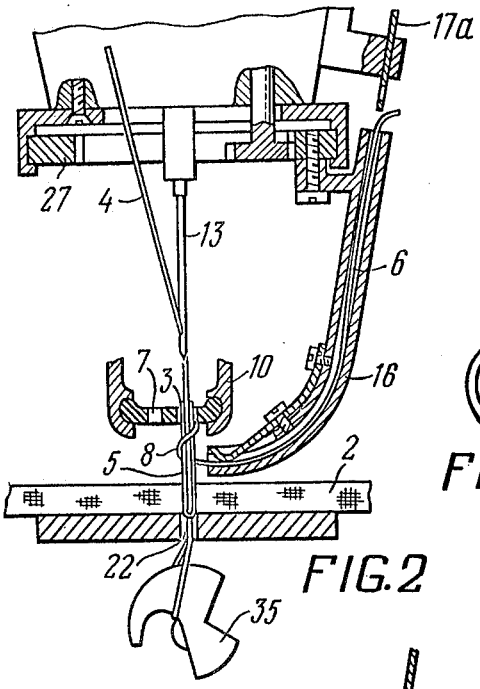
FIG. 2 illustrates the apparatus of the present invention wherein the reserve length of the thread is wrapped around the foot being formed in the process of sewing on the button according to the method of the present invention.
Figure 2A:
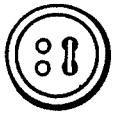
Figure 3:
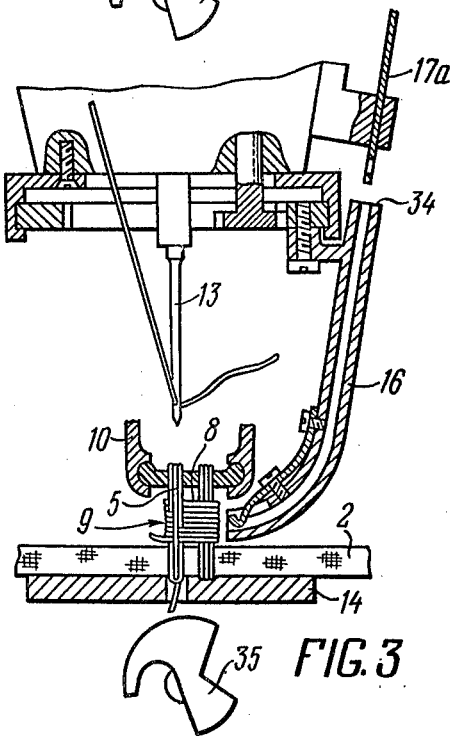
Figure 4:
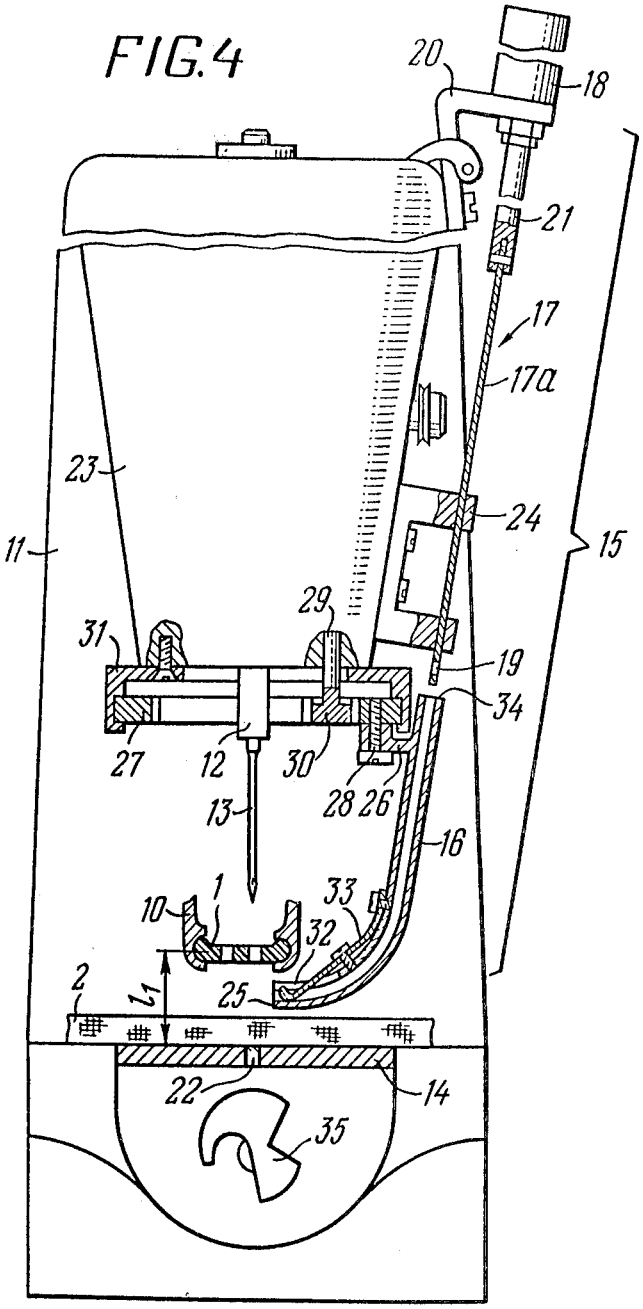

FIG. 2*a* is a plan view of the button being sewn on in FIG. 2;

FIG. 3 shows schematically the apparatus of the present invention and, particularly, the formed stem of the sewn-up button;

FIG. 4 shows schematically a front elevation of a semi-automatic machine for sewing a button on a thread stem, according to the method and apparatus of the present invention;

FIG. 5 illustrates the apparatus of the present invention positioned for engaging the needle thread, before the commencement of the process of sewing a button.

The disclosed method of sewing a button on a stem of thread comprises holding the button 1 (FIG. 1) to be sewn on at a preset spacing "l" from the cloth 2. Then through one of the holes 3 of the button 1 and through the cloth 2 the needle thread 4 is guided, of which thread a foot 5 (FIG. 2) is formed under the button 1 as described in detail below. Following the guiding of the thread 4 (FIG. 1) through the hole 3 of the button 1 and through the cloth 2, a reserve length 6 (see FIG. 1) of this thread 4 is provided between the button 1 and the cloth 2.

This reserve length 6 of the needle thread 4 is simultaneously with the ensuing guiding of the thread 4 through the holes 3 and 7 of the button 1 and through the cloth 2, wrapped around the foot 5 being formed, as can be seen in FIG. 2, to form the stem. As a result, this reserve length 6 of the thread is deposited in successive turns 8 (FIG. 3) about the foot 5, in which way the stem 9 is formed, wherein each turn 8 is intertwined with the threads 4 of the foot 5, as can be seen in FIG. 3. It is understandable that the herein disclosed method can be used for sewing on buttons 1 having four holes, as shown in FIG. 2*a*, as well as buttons having two holes (not shown).

The herein disclosed method of sewing a button on a thread stem can be performed by any existing semi-automatic machine shown schematically in FIG. 4 and adapted to sew on buttons having either two or four holes. This semi-automatic machine includes a button holder 10 mounted in a known per se manner on the housing 11 of the semi-automatic machine, intermediate the needle bar 12 with the needle 13 and the under-needle throat plate 14, at a predetermined spacing "$l_1$" from the latter, this known per se semi-automatic buttoning machine (of which the design, therefore, is not described in detail in the present disclosure) being additionally provided with the device 15 for forming the stem of thread.

This device 15 is likewise mounted on the housing 11 of the machine and includes a trough 16 rotatable about the needle 13 during the button-sewing operation and having one end underlying the button holder 10, and a means 17 for engaging the thread passing through the needle 13 and providing a reserve length thereof, after this thread has been guided through one of the holes or eyes of the button 1 and through the cloth 2.

The means 17 for engaging the needle thread and providing a reserve length thereof is mounted to enter into and pass through the trough 16 and, to underlie the button holder 10 as it engages the thread and thereafter to exit from the trough 16 upon this reserve length being formed prior to rotation of the trough 16. The means 17 includes a plate or strip 17*a* having one of its ends connected with a drive 18 and its other end provided with an opening 19.

The drive 18 for the plate 17*a* in the presently described embodiment is in the form of an air cylinder having its body carried by a bracket 20 mounted on the housing 11 of the machine. However, it is understood that other known per se driving means suitable for the purpose can be used to drive the plate 17*a*. The stroke of the plunger rod 21 of the air cylinder and its length are selected so that the plate 17*a* is driven through the trough 16 in a manner such that the end of the plate 17*a*, having the opening 19, projects from the trough 16 to underlie the button holder 10, with the hole 19 aligning, as it is shown in FIG. 5, with the opening 22 in the throat plate 14. Quite obviously, the stroke and the length of the plunger rod 21 (FIG. 4) depends on the particular arrangement of the device 17 in the machine. In the particular embodiment being described the plate 17*a* reciprocates with respect to the head 23 of the arm of the housing of the machine in guideways provided in the bracket 24 mounted on the head of the machine, as shown in FIG. 4.

The trough 16 is of an arcuate shape, as it can be seen in FIG. 4, and has a rectangular cross-section. One end 25 of the trough 16 underlies the button holder 10 at a certain distance from the axis of the opening 22 in the throat plate 14 so, that upon the trough 16 being rotated, its end 25 describes a circle with a center intersected by the axis of this opening. The other end of the trough 16 is provided with a lug 26. To effect the rotation of the trough 16, the device 15 for forming the stem includes a driving ring 27 coaxially mounted with respect to the opening 22 in the throat plate 14, the ring being rotatably mounted on the head 23 of the arm of the machine, as it can be seen in FIG. 4. The trough 16 is mounted on this ring 27 in a cantilever fashion with aid of a screw 28 passing through a bore in the lug 26. The ring 27 can be rotatably driven in any suitable manner, e.g. by means of a driving shaft 29 accommodated in the head 23 of the arm of the machine and carrying on its end a pinion 30 received inside the ring 27 and permanently meshing with an internal gear provided on the ring 27, as shown in FIG. 4. The ring 27 is supported in corresponding grooves provided in a bracket 31 fixed to the lower portion of the arm, as shown in FIG. 4, these grooves of the bracket 31 serving as the bearing for ring 27.

As it has been already stated hereinabove, the trough 16 is of an arcuate shape to provide for its space-saving accommodating, its length being determined so as to receive the entire reserve length of the thread upon the lower end of means 17 for engaging the thread withdrawing from the trough, which precludes hanging of this reserve thread length in the area of the needle 13 with the the trough 16 rotating.

The lower end 25 of the trough 16, underlying the button holder 10, has a slot 32 cut in the upper side thereof, and further has a leaf spring 33 mounted thereon as a means for tensioning the reserve length of the thread. This leaf spring has its one end secured to the trough 16, its other end extending into the slot 32 of the trough 16.

The semi-automatic machine operates, as follows.

Figure 1:
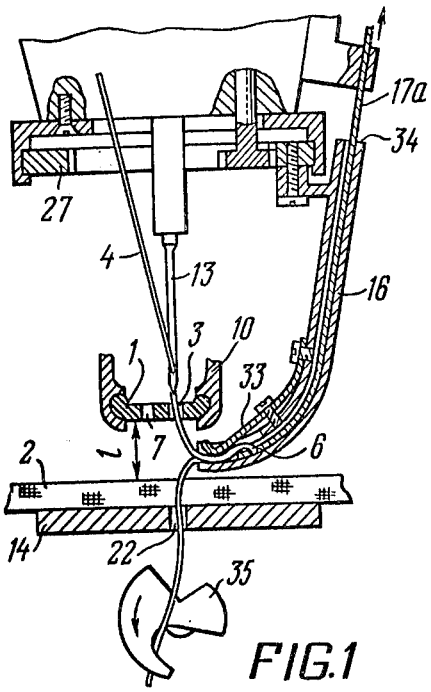
FIG. 1 illustrates schematically the apparatus of the present invention forming a reserve length of the needle thread in the process of sewing on a button according to the method of the present invention.

A button 1 (FIG. 4) is positioned in the button holder 10 under which the cloth 2 is accommodated between the trough 16 and the throat plate 14. Before the beginning of the operation of sewing on the button 1, the trough 16 is held stationary, its upper entrance end 34 underlying the plate or strip 17*a* of the means 17 for engaging the thread and providing its reserve length. Then the air cylinder 18 is energized so that plunger rod 21 introduces the plate 17*a* into the trough 16 advancing it until the opening 19 (FIG. 5) in the plate 17*a* aligns with the opening 22 in the throat plate 14. At this time the drive mechanism of the machine is energized. As the needle 13 is driven downward, the needle thread 4 (FIG. 1) is guided by the needle 13 through the hole 3 of the button 1, the opening 19 in the plate 17*a* and the cloth 2, at which time the needle thread 4 is engaged by the looping member or shuttle 35 of the machine and pulled to the underside of the cloth 2. After the needle 13 has been retracted from the hole 3 of the button 1, the plate 17*a* is returned into its initial position by the air cylinder 18, drawing the needle thread 4 behind it, as shown in FIG. 1, by pulling it under the leaf spring 33, in which manner the reserve length 6 of the upper thread is provided. Thus, while the needle is in stationary retracted position as shown in FIG. 1, the plate 17*a* continues to retract from the trough 16 until it withdraws therefrom, whereupon the end of the thread slips out from the opening 19 of plate 17*a* as shown in FIG. 2. During the successive strokes of the needle 13 through the cloth 2 the thread 4 is guided through the holes 3 and 7 of the button 1 and through the cloth 2, and the foot 5 is formed, same as in the hitherto known semi-automatic button-sewing machines, with the plate 17*a* having cleared the trough 16 and attained the idle position shown in FIG. 2. Simultaneously the ring 27, and, consequently, the trough 16 are rotated about the button 1 by the operation of the drive pinion 30, without interrupting the button sewing-on process. Thereby the reserve length 6 of the thread 4 is laid in turns 8 (FIG. 3) tight about the foot 5 being formed, whereby the wrap-around stem 8 is made, each successive turn 8 of the reserve length of the thread being secured by the successive stitches of the thread 4 being guided in the process of sewing the button 1. The stem 9 of the sewn-on button 1 acquires the shape shown in FIG. 3.

The tension of the wrap-around thread 4 is determined by the pressure of the leaf spring 33. The reserve length 6 of the thread 4, accommodated in the trough 16, is adjusted to suffice till the last button-fastening stitch, which can be done in a known trail-and-error manner.

The moment of the initiation of the rotation of the trough 16 does not influence the quality of the foot 5 and stem 9 being formed. Furthermore, there is no particular need to time the rotation of the trough 16 with the reciprocation of the needle 1.

What is claimed is:

1. In a semi-automatic machine for sewing a button on a stem of thread, comprising: a housing; a needle bar with a needle through which a needle thread passes; a throat plate located below the needle with an opening aligned with the needle for the passage of the needle with the needle thread therethrough; a button holder mounted at a predetermined spacing from said throat plate and adapted to accommodate a button having holes which is to be sewn onto a cloth adapted to be accommodated between the button holder and the throat plate, by guiding the needle thread by the needle through the holes of the button and the cloth and forming a foot from this thread, an improvement including a device for forming a stem of the needle thread mounted on said housing, said device comprising: a trough rotatably mounted about said needle adapted to rotate during the process of sewing on the botton and having one of its ends underlying said button holder; means for rotatably mounting said trough with respect to said needle; means for engaging the needle thread and providing a reserve length thereof upon this thread having been guided through one hole of the button and through the cloth, said thread engaging means being mounted for travel through said trough to underlie said button holder to engage the needle thread and to exit from the trough prior to the trough being rotated and the reserve length of the needle thread having been provided; means for driving said needle thread-engaging means for the travel through said trough and retraction therefrom; and means for rotating said trough.

2. A semi-automatic machine as set forth in claim 1, wherein said means for engaging the needle thread and providing a reserve length thereof includes a plate having one of its ends connected to said driving means, an opening being formed in the other end of the plate of said thread-engaging means and adapted to align with the opening in said throat plate upon said other end of said plate underlying said button holder, after said plate has been advanced through said trough.

3. A semi-automatic machine as set forth in claim 2, including guideways mounted on said housing, said plate of said means for engaging the needle thread and providing a reserve length thereof being accommodated in said guideways.

4. A semi-automatic machine as set forth in claim 1, including a ring rotatably mounted on said housing and arranged coaxially with the opening in said throat plate, said ring having said trough mounted thereon in a cantilever fashion; and means for rotating said ring, whereby said ring acts as the drive means effecting rotation of said trough.

5. A semi-automatic machine as set forth in claim 4, wherein said trough has an arcuate shape, its length having been selected to accommodate the full reserve length of the needle thread upon said means for engaging the needle thread and forming the reserve length thereof having cleared said trough.

6. A semi-automatic machine as set forth in claim 1, wherein said trough has a slot formed in the end thereof underlying said button holder; means for tensioning the reserve length of the needle thread in said trough being provided, including a leaf spring having one of its ends secured to said trough and its other end extending into said slot of said trough.

* * * * *